United States Patent [19]

Thompson

[11] 4,300,657

[45] Nov. 17, 1981

[54] SCAFFOLD

[76] Inventor: H. Truett Thompson, 1821 Muse, Fort Worth, Tex. 76112

[21] Appl. No.: 143,595

[22] Filed: Apr. 25, 1980

[51] Int. Cl.[3] ..... E04G 1/24; E04G 1/28; E04G 1/36

[52] U.S. Cl. ..... 182/38; 182/150; 182/214

[58] Field of Search ..... 182/36, 38, 39, 150, 182/82, 12, 13, 117, 230, 214

[56] References Cited

U.S. PATENT DOCUMENTS

| | | | |
|---|---|---|---|
| 460,501 | 9/1891 | Coburn et al. | 182/39 |
| 1,176,652 | 3/1916 | Clark | 182/38 |
| 2,692,168 | 10/1954 | Gregory | 182/12 |
| 2,844,187 | 7/1958 | Scoville | 182/36 |
| 3,305,113 | 2/1967 | Gardner | 182/150 |
| 3,340,960 | 9/1967 | Wilson | 182/117 |
| 3,425,510 | 2/1969 | Fedoryk | 182/117 |
| 3,472,338 | 10/1969 | Weidman | 182/82 |
| 4,078,633 | 3/1978 | Fahy | 182/82 |
| 4,232,759 | 11/1980 | Jacobs | 182/117 |

*Primary Examiner*—Reinaldo P. Machado
*Attorney, Agent, or Firm*—James E. Bradley

[57] ABSTRACT

A scaffolding apparatus has features that are easy to carry and easy to assemble. The scaffolding apparatus includes a pair of legs that are connected together by a horizontal rail. Standoff means supports the scaffold against the building, with the legs inclining toward the building and the rails spaced away from the building. A worker's platform is carried by the rail below the rail and for movement along the rail.

9 Claims, 12 Drawing Figures

SCAFFOLD

BACKGROUND OF THE INVENTION

1. Field of the Invention

This invention relates in general to scaffolds particularly for use in building construction and repair.

2. Description of the Prior Art

Most scaffolds available are of a type that includes two rectangular end pieces that are secured together by cross-braces. If additional height is required, additional end pieces are mounted on top and secured by additional cross-pieces. Screw jacks can be mounted to the bottoms of the end pieces to level the scaffolding and to vary the total height slightly.

While this type of scaffolding is suitable for extensive repair and reconstruction work, the assembly may be too time consuming for painters, particularly for work at heights less than 25 feet. Consequently, painter's often use ladders, or they may hang a board between two ladders for painting. One disadvantage of the latter arrangement is that since the board would not have any supporting structure other than the ladders, a painter may lose his balance and fall. Also, if the ground is unlevel, the ladders may be unstable and the board may be tilted.

SUMMARY OF THE INVENTION

It is accordingly a general object of this invention to provide an improved scaffold.

It is a further object of this invention to provide an improved scaffold that is easy and fast to erect, and can be used on unlevel ground.

In accordance with these objects, a scaffold is provided that includes a pair of legs. Each leg has telescoping means to increase the length more than double from the collapsed position. The two legs are connected together by a horizontal rail. Standoff arms support the rail away from the building, with the two legs inclining toward the building. A worker's platform is carried below the rail by rollers that will roll along the length of the rail. The platform is supported in a horizontal position by a brace that interconnects the legs parallel to the rail.

DESCRIPTION OF THE PREFERRED EMBODIMENT

Figure 1:
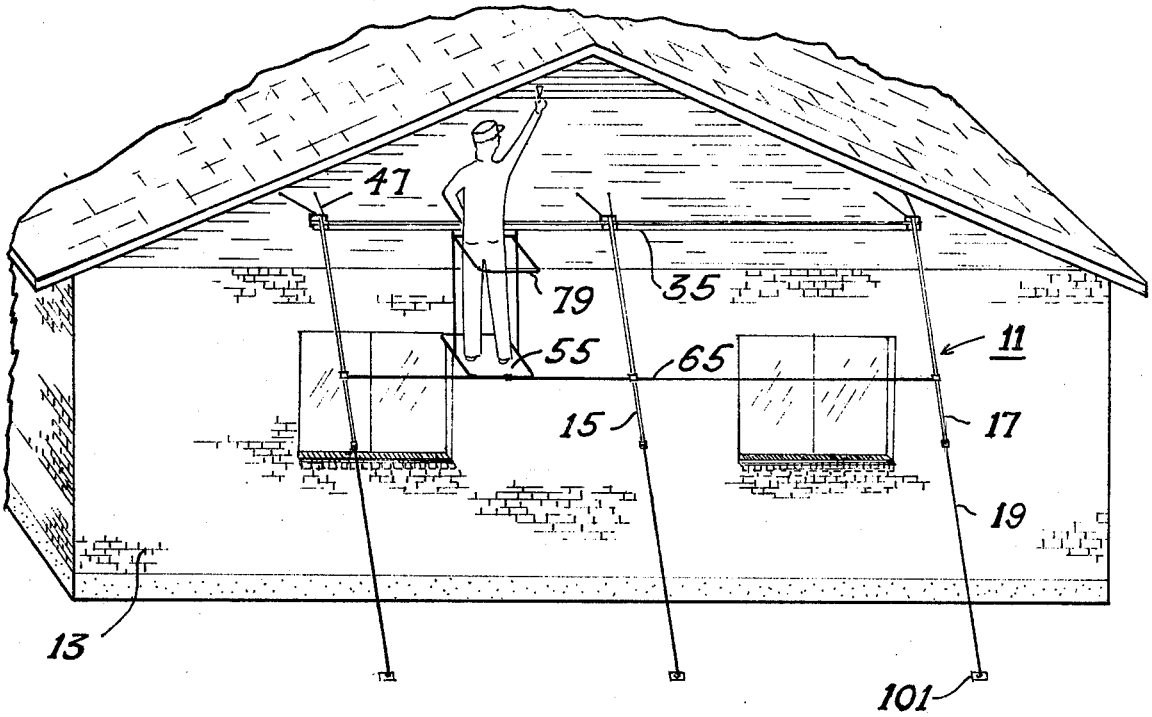
FIG. 1 is a perspective view of a scaffold constructed in accordance with this invention, shown in an extended position.
Figure 4:
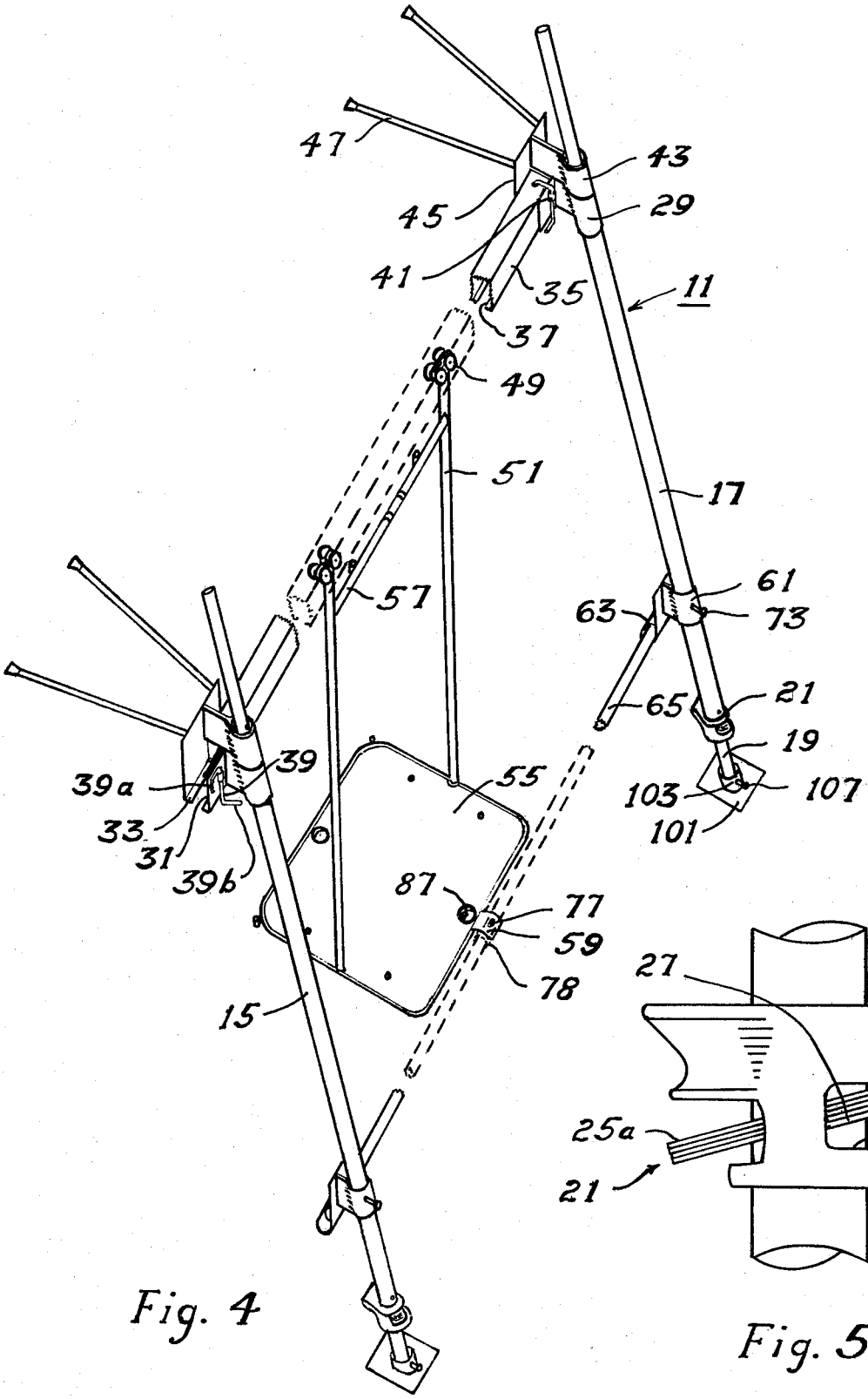
FIG. 4 is an enlarged perspective view, partially broken away, of the scaffold of FIG. 1.

Referring to FIG. 1., scaffold 11 is shown erected against the wall 13 of a house. Referring to FIG. 4, scaffold 11 has a pair of legs 15. Each leg 15 has a pipe or tube 17 that slidingly receives an inner pipe or rod 19 for serving as telescoping means for varying the length of the leg. The length of the inner rod 19 is greater than the length of the tube 17.

Figure 5:
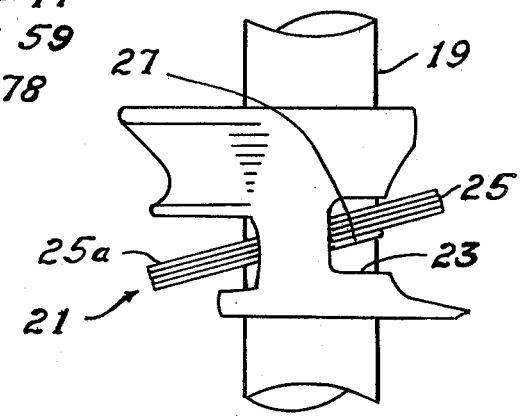
FIG. 5 is an enlarged side view of one of the locking devices for the scaffold of FIG. 1.

Locking means for locking the rod 19 to tube 17, shown also in FIG. 5, consists of a conventional pipe clamp 21, such as used for gluing furniture. Pipe clamp 21 has an inner bore 23 that slidingly receives the inner rod 19. Gripping means allows the rod 19 to slide downwardly with respect to the pipe clamp 21, but prevents upward movement, unless released. In the pipe clamp shown in FIG. 5, the gripping means includes a plurality of plates 25, each having an aperture for receiving rod 19. The plates 25 are biased downward by a spring 27. The apertures in the plates 25 are slightly larger than the diameter of the rod 19, and wedge rod 19 against movement in the upward direction with respect to the pipe clamp 21. The plates 25 will release the rod 19 for upward movement with respect to the clamp 21 by pressing the ends **25*a* of the plates 25 upward, to align the plates 25 perpendicular to the rod 19, and thus release the wedging action. The upper surface of the pipe clamp 21 bears against the lower edge of the tube 17, tube 17 having an outer diameter that is greater than the inner diameter of the bore 23 of the pipe clamp 21**.

Figure 7:
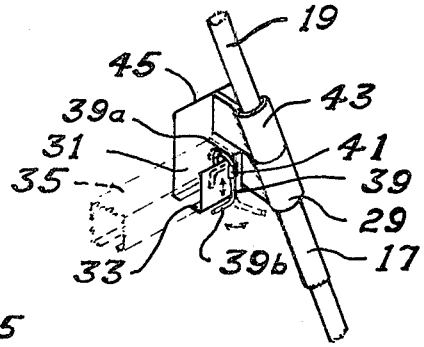
FIG. 7 is an enlarged perspective view of the device for locking the rail to the legs for the scaffold of FIG. 1.

A rail bracket 29 is welded to the tube 17 near its top. Referring to FIG. 7, the rail bracket 29 has a socket that consists of a rectangular channel 31 that has an open top and faces upwardly. A slot 33 is located on the bottom side of the channel 31. Channel 31 is located on the side of the leg 15 that is adjacent the building wall 13. Referring again to FIG. 4, rail bracket 29 is adapted to receive a rail 35 in its channel 31. Rail 35 is a rectangular tube having a slot 37 on its bottom side. Each end of the rail 35 will slide within the rail brackets of channel 31, with the rail slot 37 aligning with the channel slot 33. Each end of rail 35 is open.

A locking device for holding the rail 35 in the rail bracket 29 consists of a fastener 39, as shown also in FIG. 7. Fastener 39 is a stiff wire that has a vertical portion pivotally and slidably connected to the outside wall of the rail bracket channel 31 by a semi-circular loop 41. The top portion of the fastener 39 is bent horizontally with respect to the vertical portion to extend over the top of the rail bracket channel 31. This top portion terminates in a depending finger **39*a* that engages an aperture in the top side of the rail 35. On the lower end of the fastener 39, a handle section 39*b* is bent horizontally, but at a right angle with respect to the upper section of the fastener. The lower section 39*b* provides means to raise the fastener and pivot it between the locked position, as shown in FIG. 4 on the right side, or the unlocked position, as shown in FIG. 4 on the left side. The dotted lines and the arrows in FIG. 7** show this movement.

A standoff means for supporting this scaffold against the building is mounted to each leg 15. The standoff apparatus includes a standoff bracket 43, as shown in FIG. 4 that is welded to the top of the tube 17. Bracket 43 has a plate 45 adapted to be located on the inside of each leg 15 and located in a plane that lies in an acute angle, preferably 15°, with respect to the plane containing the axis of the legs 15. Each plate 45 has two arms 47 extending outward from it for bearing against the building wall 13. The axes of the arms 47 are located in a plane that intersects the plane of plate 45 at 90° degrees. The axes of the arms 47 thus lie in a plane that intersects the plane containing the axes of the legs 15 at an obtuse angle, preferably 105°. When erected, the plane containing the axes of the arms 47 will be horizontal and perpendicular to the vertical building wall 13. The plane containing the axis of the legs 15 will be 75° with respect to horizontal. The arms 47 also converge outwardly toward the building to provide better support.

Figure 11:
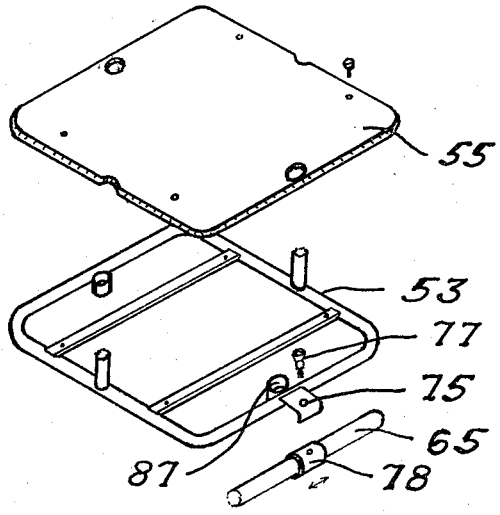
FIG. 11 is an exploded view of a portion of the worker's platform for the scaffold of FIG. 1.

Referring to FIG. 4, two tandem sets of rollers 49 are adapted to be carried in the rail 35. Each set of rollers 49 has four wheels; two wheels for engaging the rail surface or track located on one side of slot 37, and two wheels for engaging the track located on the other side of slot 37. Each set of rollers 49 has two axles, which support a single depending rod 51. Rods 51 depend in a vertical plane, parallel with building wall 13 and perpendicular with the plane containing the axes of the arms 47. The lengths of rods 51 are equal and about three feet, or slightly more than one-half the average height of a worker. The lower ends of the rods are connected to a tubular rectangular frame 53 that supports a flat plate or platform 55, as shown in FIG. 11. One rod 51 is located on each side edge of the rectangular platform 55. A bar 57 located near the upper ends of the rods 51 maintains the rods 51 parallel with each other. Platform 55 is carried by rods 51 in a horizontal plane perpendicular to rods 51. A curved tab 59 extends outwardly from the platform 55 on the outer side edge, as shown in FIG. 4 and FIG. 11.

Figure 9:
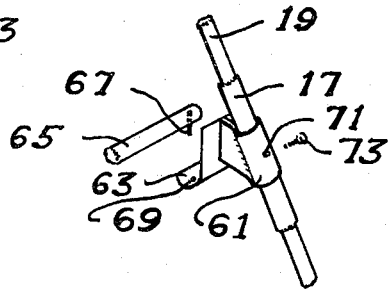
FIG. 9 is an enlarged perspective view of the device for securing the brace of the scaffold of FIG. 1.

A brace bracket 61 is welded to each tube 17 at a distance approximately equal with the platform 55, when assembled. Brace bracket 61 has a socket comprising a curved channel 63, as shown in FIG. 9. Channel 63 is located on the inner side of the legs 15 and is adapted to receive a cylindrical bar or brace 65 that extends between the legs 15 parallel with rail 35. A pin 67 depending from each end of the brace 65 is adapted to engage a hole 69 located in each upwardly facing channel 63. Brace bracket 61 also has a threaded hole 71 for receiving a screw 73, as shown in FIG. 9. The tube 17 has an aperture (not shown) that registers with hole 71, allowing the screws 73 to frictionally contact the inner rod 19 to serve as a backup locking device in case the pipe clamps 21 slip.

Figure 6:
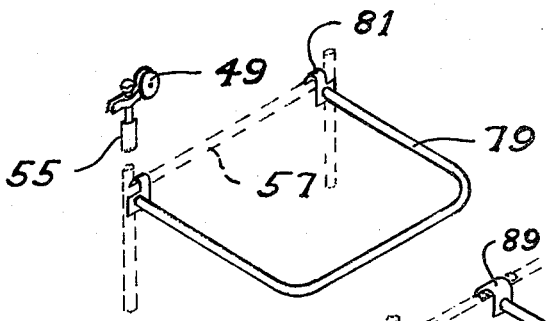
FIG. 6 is a perspective view of a safety bar for the scaffold of FIG. 1.

The platform tab 59 has a hole 75 for receiving a screw 77. Screw 77 extends through the hole 75 and secures platform 55 to a sleeve 78 that is slidingly carried on brace 65 to serve as engaging means for maintaining the platform in a horizontal position. Referring to FIG. 6, a safety rail 79 is adapted to be mounted to the platform bar 57. Safety rail 79 is generally in the configuration of a "U", and has curved clips 81 on each end for looping over the bar 57. A portion of each clip bears against the rods 51 to support the safety rail 79 perpendicular to the rods 51.

Figure 8:
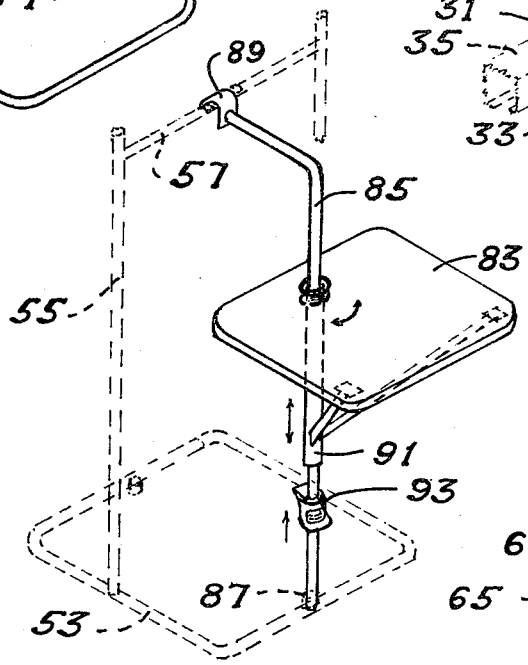
FIG. 8 discloses a seat that can be used with the platform of the scaffold of FIG. 1.
Figure 10:
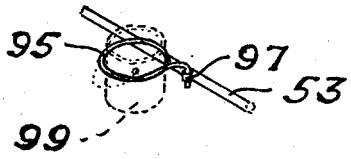
FIG. 10 discloses a hanger for holding a paint bucket for the scaffold of FIG. 1.

Referring to FIG. 8, a seat 83 can be installed above the platform 55 if desired. Seat 83 is supported on a bar 85 that has a vertical portion that will engage a socket 87 (FIG. 11) in the platform frame 53. A horizontal portion of bar 55 has a clip 89 that loops over the upper bar 57. The seat 83 is welded to a sleeve 91 that slides on the vertical portion of bar 85. A pipe clamp 93 prevents downward motion of the sleeve 91 at any selected position at which the pipe clamp 93 is secured. Pipe clamp 93 is of the same type as pipe clamp 21 in FIG. 5, and is secured around the vertical portion of the bar 85. Referring to FIG. 10, a loop 95 is pivotally supported in a socket 97 on frame 53. Loop 95 will support a paint bucket 99, as indicated by the phantom lines.

Figure 12:
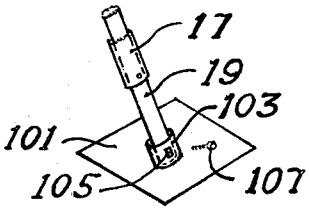
FIG. 12 is a perspective view of the lower end of one of the legs of the scaffold of FIG. 1.

Each leg 15 is supported by a rectangular plate 101, as shown in FIG. 12. Each plate 101 has a socket 103 that loosely receives an inner rod 19. An elongated hole 105 in the socket 103 receives a screw 107 that screws into a threaded hole (not shown) in the bottom of each inner rod 19. The enlarged diameter of the socket 103 and the elongated hole 105 allow a certain amount of flexing of the plate 101 with respect to the inner rod 19, to account for rough ground surface.

In operation, the scaffold 11 will normally be brought to the worksite in an unassembled condition. Platform 55 will be detached from rail 35, and rail 35 and brace 65 will be detached from legs 15. At the site, first the legs 15 are positioned against the building wall 13 and the heights adjusted by sliding the pipe clamps 21 on inner rods 19 to the proper amount of extension of inner rods 19. The standoff arms 47 will be in contact with the building wall, and the legs 15 will be leaning toward the wall at about the same angle of inclination as the safe angles of inclination for a ladder, approximately 75° with respect to horizontal. Once the height is selected, the screws 73 in the brace brackets 61 may be turned to further lock the inner rod 19 within the tube 17. Then, rail 35 maybe placed in position, interconnecting the legs. Once the ends of rail 35 are located in the sockets 31 of the rail brackets 29, one fastener 39 can be pivoted to the closed position, as shown in FIGS. 4 and 7. Then the brace 65 may be placed into the brace socket 63. Then the platform 55 may be rolled into engagement with the rail 35 through the end that has the fastener 39 in the open position. Once the platform 55 is located between the legs 15, its tab 59 is secured to sleeve 78 to prevent any rocking movement of the platform 55 and to maintain the platform horizontal. The open fastener 39 is then pivoted to the closed position so that its finger 39*a* will prevent the platform rollers 49 from rolling out of the end of the rail.

Figure 2:
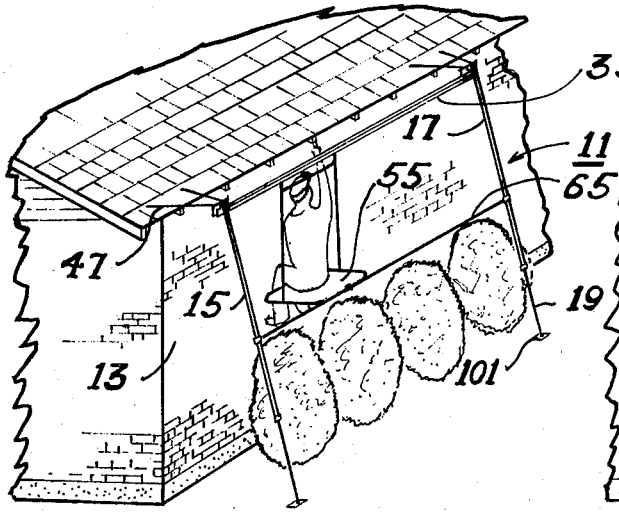
FIG. 2 is a perspective view of the scaffold of FIG. 1, with the scaffold shown in an intermediate position.
Figure 3:
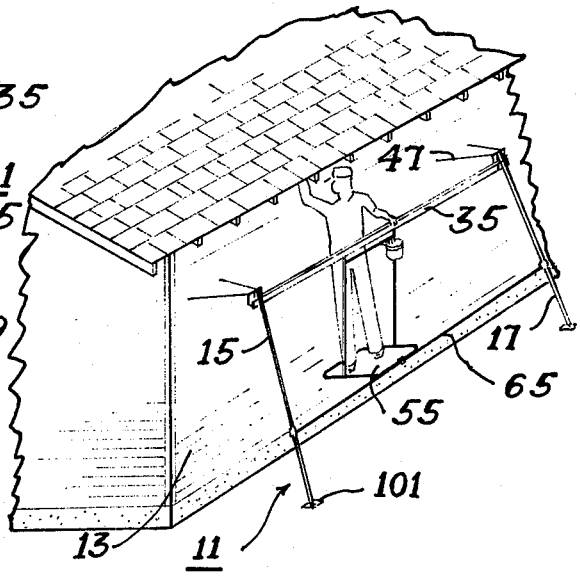
FIG. 3 is a perspective view of the scaffold of FIG. 1, with the scaffold shown in a lower position.

The scaffold can be used at this point, such as shown in FIG. 2, without the safety rail 79 or seat 83. The worker may install the safety rail 79 and seat 83, if desired. A stepladder will normally be used to reach the platform 55. As shown in FIG. 3 and FIG. 1, the worker can stand on the inner side of the rail 35, if desired, since the arms 47 support the rail 35 away from the building wall 13. Also, the worker can stand on the outside of the rail 35, as shown in FIG. 1. As the work progresses, the platform 55 maybe rolled along the length of rail 35 with sleeve 78 sliding on brace 65.

As shown in FIG. 1, although two legs may be used, three or more legs may be used to widen the total width of the scaffold. Rollers 49 can roll directly from one rail 35 into another, with fastener 39 in the unlocked position. The height of the scaffold may be varied by shifting the pipe clamps 21, which can provide gradual height increase to more than double the length from the fully collapsed position shown in FIG. 3.

The invention has significant advantages. The scaffolding is lightweight, may be broken down into small components and is quickly assembled. One leg can be lengthened while the other shortened, to accommodate for unlevel ground, the brace and safety rail provide safer conditions than exist with ladder-type scaffolds. The height can be gradually varied.

While the invention has been shown in only one of its forms, it should be apparent to those skilled in the art that it is not so limited, but is susceptible to various changes and modifications without departing from the spirit thereof.

I claim:

1. A scaffolding apparatus, comprising:

a pair of legs, each of the legs having telescoping means for varying its length;

a rail interconnecting the legs;

standoff means for supporting the apparatus against a building with the legs in an inclined position and with the rail spaced away from the building and in a horizontal position; and a worker's platform carried by the rail below the rail for movement along the rail between the legs.

2. The apparatus according to claim 1 wherein the rail has a track, and wherein the platform is secured to a pair of rods, each rod having a roller on its upper end that engages the track.

3. The apparatus according to claim 1 further comprising:

a brace interconnecting the legs parallel with the rail and located substantially at the level of the platform; and engaging means connecting the platform and the brace for maintaining the platform in a horizontal position and allowing the platform to move lengthwise with respect to the rail and the brace.

4. A scaffolding apparatus, comprising:

a pair of legs, each of the legs having telescoping means for varying its length;

a pair of rail brackets, one mounted to each leg, each rail bracket having a socket;

a rail comprising a hollow rectangular tube with a slot on a lower side, defining a pair of tracks separated by the slot, the ends of the rail adapted to slide into the sockets of the brackets, interconnecting the legs with the rail perpendicular to them;

two sets of rollers carried in the rail, each set having a wheel engaging each track, each set mounted to a rod that extends downwardly through the slot;

a worker's platform secured to the rods in a plane perpendicular to the rod;

standoff means for supporting the apparatus against a building with the legs in an inclined position and with the rail spaced away from the building;

a brace interconnecting the legs parallel with the rail and located substantially at the level of the platform; and a sleeve slidingly carried by the brace; the platform having a tab on one edge adapted to be secured to the sleeve.

5. The apparatus according to claim 4 wherein the brace is connected to the legs by a pair of brace brackets, each brace bracket being secured to one of the legs and having an upwardly facing channel for receiving an end of the brace.

6. The apparatus according to claim 4 wherein the socket for each rail bracket is an upwardly facing channel, and wherein the rail is releasably secured in each of the rail brackets by a fastener, each fastener having a vertical portion pivotally and slidably mounted to one of the rail brackets, a horizontal portion adapted to extend over the channel of the rail bracket when pivoted to a locking position, and a finger extending downwardly from the horizontal position for engaging a hole in the rail when in the locking position.

7. A scaffolding apparatus, comprising:

a pair of legs, each leg having an inner rod slidably carried within an outer tube;

locking means for selectively locking the inner rods to the tubes to vary the lengths of the legs;

a pair of rail brackets, each mounted to one of the tubes near the upper end of the tube, each rail bracket having a socket;

a rail adapted to slide into the sockets of the rail brackets, interconnecting the legs with the rail perpendicular to the legs, the rail having a horizontal surface extending the length of the rail for defining a track;

two sets of rollers carried on the track, each set being mounted to a rod that depends downwardly;

a worker's platform having two side edges secured to the rods in a plane perpendicular to the rods;

a pair of arms, each arm rigidly carried by one of the tubes at the top and extending laterally outward from the leg at an obtuse angle with respect to the leg, for supporting the apparatus against a building with the legs inclined toward the building and the rail spaced away from the building;

a pair of brace brackets, each secured to one of the tubes at substantially the level of the platform, each having a socket;

a brace adapted to slide into the sockets of the brace brackets parallel with the rail and interconnecting the legs; and engaging means connecting the platform and the brace for maintaining the platform in a horizontal position and allowing the platform to move lengthwise with respect to the rail and the brace.

8. The apparatus according to claim 7 wherein the locking means comprises a pipe clamp having a bore for receiving the inner rod and gripping means for selectively preventing the inner rod from sliding with respect to the pipe clamp, the pipe clamp being in contact with the lower end of the tube for selectively preventing upward movement of the inner rod with respect to the tube.

9. The apparatus according to claim 7 wherein the inner rod is greater than the length of the tube.

* * * * *